US012427434B2

(12) United States Patent
Hama et al.

(10) Patent No.: US 12,427,434 B2
(45) Date of Patent: Sep. 30, 2025

(54) SPINNING TOP TOY

(71) Applicant: TOMY COMPANY, LTD., Tokyo (JP)

(72) Inventors: Hiroyuki Hama, Tokyo (JP); Yohei Bando, Chiba (JP); Takeaki Maeda, Tokyo (JP); Douglas Arthur Schultheis, Cumberland, RI (US)

(73) Assignee: TOMY COMPANY, LTD., Tokyo (JP)

( * ) Notice: Subject to any disclaimer, the term of this patent is extended or adjusted under 35 U.S.C. 154(b) by 420 days.

(21) Appl. No.: 17/866,408

(22) Filed: Jul. 15, 2022

(65) Prior Publication Data

US 2023/0211243 A1 Jul. 6, 2023

Related U.S. Application Data

(60) Provisional application No. 63/295,473, filed on Dec. 30, 2021.

(51) Int. Cl.

| | |
|---|---|
| ***A63H 1/02*** | (2006.01) |
| ***A63H 1/00*** | (2019.01) |
| ***A63H 1/10*** | (2006.01) |

(52) U.S. Cl.

CPC ..... *A63H 1/02* (2013.01); *A63H 1/00* (2013.01); *A63H 1/10* (2013.01)

(58) Field of Classification Search

CPC ... A63H 1/00; A63H 1/02; A63H 1/10; A63H 1/12; A63H 1/18

See application file for complete search history.

(56) References Cited

U.S. PATENT DOCUMENTS

| | | | | |
|---|---|---|---|---|
| 5,941,753 | A * | 8/1999 | Diresta | A63H 1/18 446/257 |
| 6,443,801 | B1 * | 9/2002 | Bell | A63H 1/00 446/256 |
| 9,101,845 | B2 * | 8/2015 | Cai | A63H 1/18 |
| 9,802,134 | B2 * | 10/2017 | Cai | A63H 1/02 |
| 9,914,061 | B2 * | 3/2018 | Cai | A63H 33/26 |
| 10,029,185 | B2 * | 7/2018 | Cai | A63H 1/18 |
| 10,421,022 | B2 * | 9/2019 | Muraki | A63H 1/04 |

(Continued)

FOREIGN PATENT DOCUMENTS

CN 208852412 U 5/2019

*Primary Examiner* — Eugene L Kim
*Assistant Examiner* — Alyssa M Hylinski
(74) *Attorney, Agent, or Firm* — IP Business Solutions, LLC.

(57) ABSTRACT

A top toy includes a shaft part, a trunk part, and a top tip cover. The trunk part is detachably configured on the shaft part. The top tip cover is detachably configured on the shaft part at a longitudinal end. The shaft part includes a first engagement part being movably configured between a raised position and a lowered position in an axial direction and a second engagement part. The top tip includes a third engagement part being configured to be engaged by rotating in a first direction with the second engagement part to prevent the shaft part from separating from the trunk part in the axial direction. The top tip cover includes a fourth engagement part being configured to be engaged with the first engagement part to prevent the top tip cover from rotating in a second direction with respect to the shaft part.

7 Claims, 16 Drawing Sheets

(56) References Cited

U.S. PATENT DOCUMENTS

| | | | | |
|---|---|---|---|---|
| 10,434,401 | B2 * | 10/2019 | Hashiba | A63F 3/00895 |
| 10,525,365 | B2 * | 1/2020 | Muraki | A63H 1/02 |
| 10,960,317 | B2 * | 3/2021 | Hama | A63H 1/04 |
| 2011/0256796 | A1 * | 10/2011 | Ujita | A63H 1/00<br>446/264 |
| 2020/0114271 | A1 * | 4/2020 | Muraki | A63H 1/02 |
| 2020/0114273 | A1 * | 4/2020 | Muraki | A63H 1/04 |
| 2020/0269145 | A1 * | 8/2020 | Muraki | A63H 1/18 |

* cited by examiner

SPINNING TOP TOY

CROSS-REFERENCE TO RELATED APPLICATIONS

This Non-Provisional Application claims priority to Provisional Application No. 63/295,473 filed on Dec. 30, 2021. The entire content of the Provisional Application No. 63/295,473 is incorporated herein by reference.

TECHNICAL FIELD

The present invention relates to a top toy.

BACKGROUND ART

Conventionally, a top toy provided with a top tip cover to make it hard for the top toy to fall over has been known (see Patent Document 1, for example). With this top toy, it is possible to change how hard it is for the top toy to fall over based on attaching and not attaching the top tip cover to the top toy, so it is possible to make changes to playing.

PRIOR ART DOCUMENTS

Patent Documents

[Patent Document 1] CN208852412U

SUMMARY OF THE INVENTION

Problems the Invention Is Intended to Solve

With this top toy, by fitting a top tip cover on a shaft part from the top axial direction, the top tip cover is attached to the shaft part.

However, there is the problem that the top tip cover comes off the shaft part easily.

For example, when the top tip cover and the shaft part are not fitted sufficiently well, or when the fitting parts become worn out with aging, there is a risk that the top tip cover attached to the shaft part will come off. There was also the problem that if the top tip cover fell off during rotation of the top toy, the desired top toy play cannot continue.

The present invention was created taking these circumstances into consideration, and its purpose is to provide a top toy for which a cover will not come off while a trunk part is mounted on the shaft part.

Means for Solving the Problems

A top toy arranged to rotate around an axis includes a shaft part, a trunk part, and a top tip cover. The shaft part includes a longitudinal end and extending in an axial direction. The trunk part is detachably configured on the shaft part. The top tip cover is detachably configured on the shaft part at the longitudinal end.

The shaft part includes a first engagement part being movably configured between a raised position and a lowered position in the axial direction and a second engagement part. The first engagement part is urged towards the raised position. The first engagement part is at the lower position when the trunk part is configured on the shaft part.

The top tip includes a third engagement part being configured to be engaged by rotating in a first direction with the second engagement part to prevent the shaft part from separating from the trunk part in the axial direction. The top tip cover includes a fourth engagement part being configured to be engaged with the first engagement part to prevent the top tip cover from rotating in a second direction with respect to the shaft part, where the first direction is opposite to the second direction.

The top tip cover is arranged to be in contact with a floor when the top tip cover is configured on the shaft part. The shaft part is arranged to be in contact with the floor when the top tip cover is not configured on the shaft part.

MODES FOR CARRYING OUT THE INVENTION

Following, embodiments of the present invention are explained.

Figure 1:
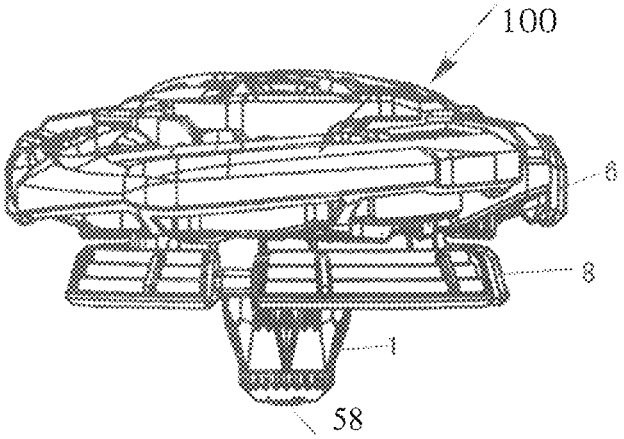
FIG. 1 is a front view of a top toy.
Figure 2:
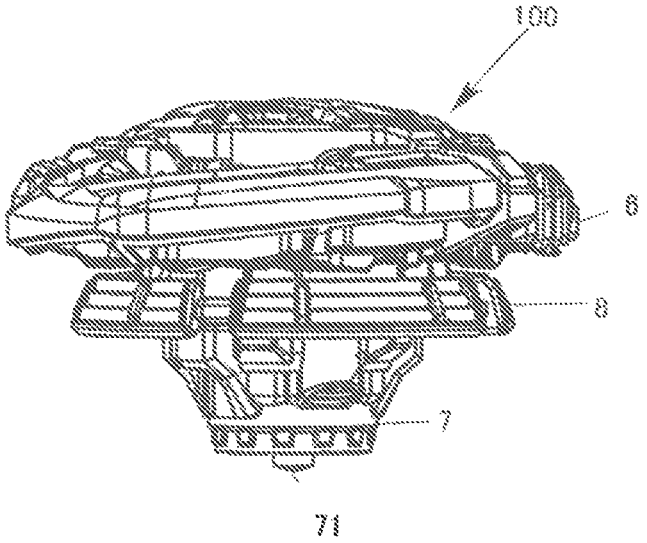
FIG. 2 is a front view of the top toy shown in a state with a top tip cover attached.
Figure 3:
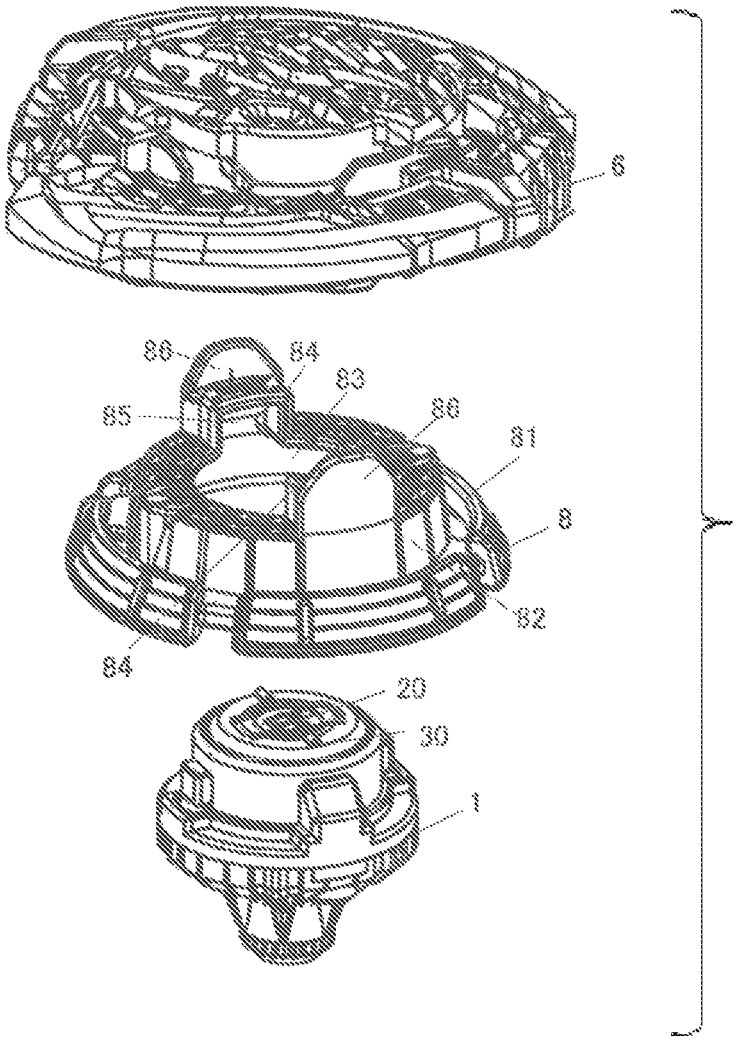
FIG. 3 is an exploded perspective view of the top toy.

FIG. 1 is a front view of a top toy 100. FIG. 2 is a front view of the top toy 100 showing a state with a top tip cover 7 attached. FIG. 3 is an exploded perspective view of the top toy 100.

The top toy 100 is formed mostly from plastic, and comprises a shaft part 1, a trunk part 6, a flywheel 8 made of metal, and a top tip cover 7 which is an accessory component. Of these, the trunk part 6 and the flywheel 8 are configured to be detachable with respect to the shaft part 1. The top tip cover 7 is also configured to be detachable with respect to the shaft part 1. The flywheel 8 may also be made of plastic.

Following, each part is explained in detail.

(Shaft Part 1)

Figure 4:
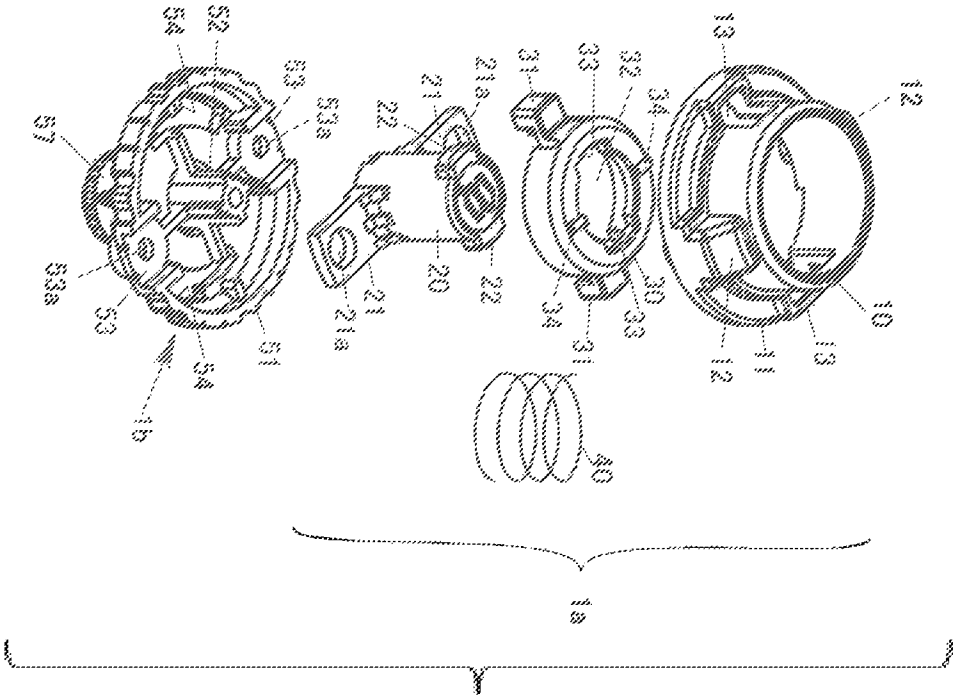
FIG. 4 is an exploded perspective view of a shaft part.

FIG. 4 is an exploded perspective view of the shaft part 1.

The upper structure of the shaft part 1 constitutes a mounting unit 1*a* of the trunk part 6. The mounting unit 1*a* comprises a cylinder body 10, a cylindrical body 20, a ring-shaped body 30, and a coil spring 40 made of metal.

Of these, a ring-shaped flange part 11 is formed on the lower end of the cylinder body 10. On the cylinder body 10, two bulging parts 12, 12 that protrude on the flange part 11 outside of the cylindrical portion are provided, and two notch parts 13, 13 that extend over the cylindrical portion and the flange part 11 are formed. The two bulging parts 12, 12 are provided to be point symmetrical to each other with respect to the rotation axis (top axis) of the top toy 100. The two notch parts 13, 13 are also provided to be point symmetrical to each other with respect to the top axis. The bulging parts 12 and the notch parts 13 are formed at a location separated by 90 degrees from each other around the top axis.

The cylindrical body 20 is installed in the center of this cylinder body 10.

The top end of the cylindrical body 20 projects slightly upward from the top end of the cylinder body 10. The cylindrical body 20 is hollow, and the hollow part is opened facing downward.

At the lower end of the cylindrical body 20, two rectangular fixed pieces 21, 21 that protrude radially outward are attached. The two fixed pieces 21, 21 are provided to be point symmetrical to each other with respect to the top axis. The protruding direction of the fixed pieces 21 is the same as the protruding direction of the bulging parts 12. A screw insertion hole 21*a* is formed on each fixed piece 21.

On the top end of the cylindrical body 20, two claws (fifth engagement parts) 22, 22 that protrude radially outward are attached. The two claws 22, 22 are provided to be point symmetrical to each other with respect to the top axis. The protruding direction of the claws 22 corresponds to the formation direction of the notch parts 13.

On the inside of the cylinder body 10, the ring-shaped body (moving body) 30 is arranged to encircle the cylindrical body 20. At the lower end of the ring-shaped body 30, two hook-shaped leg parts (first engagement parts) 31, 31 bent downward are formed at positions corresponding to the two notch parts 13, 13.

The outer edge of the ring-shaped body 30 has a shape that hangs down from a ring-shaped ceiling wall. Two notched parts 33, 33 that open to a center hole 32 are formed corresponding to the two claws 22, 22 on the ceiling wall of the ring-shaped body 30. Furthermore, two protrusions 34, 34 that extend in the radial direction are formed on the top surface of the ceiling wall. The two protrusions 34, 34 are formed to be point symmetrical to each other with respect to the top axis. The notch parts 33 and the protrusions 34 are formed at locations separated by 90 degrees from each other around the top axis.

Below the ring-shaped body 30, a coil spring 40 is provided arranged to encircle the cylindrical body 20. This coil spring 40 energizes the ring-shaped body 30 facing upward.

The lower structure of the shaft part 1 is configured as a top tip 1*b*.

The top tip 1*b* is constituted from a single member here, and comprises a tray-shaped disk part 51 on the top end. At the center of the disk part 51, a central pillar 52 that fits from below in the hollow part of the cylindrical body 20 is erected. On the top surface of the disk part 51, two seats 53, 53 are formed to situate the two fixed pieces 21 of the cylindrical body 20, and a screw insertion hole 53*a* is formed in each seat 53. The screw insertion hole 53*a* is configured so that the opening on the bottom surface side of the disk part 51 is a counterbore hole.

Figure 5:
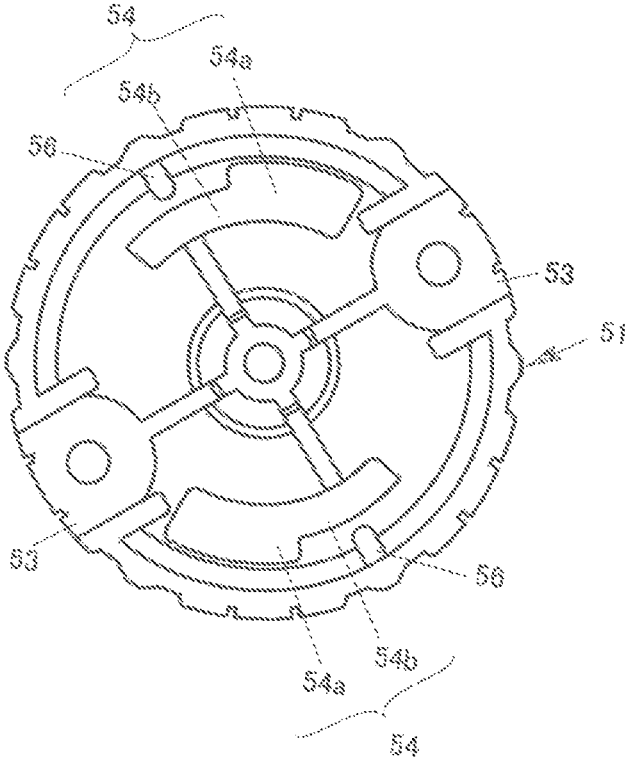
FIG. 5 is a plan view of a top tip.

Furthermore, two arc-shaped slits 54, 54 concentric with the top axis are formed on the disk part 51. The two arc-shaped slits 54, 54 are formed to be point symmetrical to each other with respect to the top axis. As shown in the plan view of the top tip 1*b* of FIG. 5, in each arc-shaped slit 54, one side of the circumferential direction is a wide width section 54*a* and the other side is a narrow width section 54*b*. Each of the length dimensions in the circumferential direction of the wide width section 54*a* and the narrow width section 54*b* is substantially the same as the width dimension of the leg part 31.

On the disk part 51, a projection 56 for positioning is formed radially outward of the narrow width section 54*b* of each arc-shaped slit 54.

Meanwhile, a shaft rod 57 is vertically installed at the bottom surface center of the disk part 51. A hemispherical landing part 58 (see FIG. 9) is formed on the bottom surface center of the shaft rod 57.

(Assembly Method for the Shaft Part 1)

The cylindrical body 20 is placed on the top surface of the disk part 51 of the top tip 1*b*. At this time, the two fixed pieces 21, 21 of the cylindrical body 20 are placed on the two seats 53, 53.

Next, the coil spring 40 is arranged to encircle the cylindrical body 20. After that, the ring-shaped body 30 is fitted on the cylindrical body 20 from above. At this time, each claw 22 of the cylindrical body 20 and each notch part 33 of the ring-shaped body 30 are matched.

Next, the cylinder body 10 is placed on the top tip 1*b*. At this time, the bulging parts 12 are matched on the seats 53, and the notch parts 13 to the leg parts 21 of the ring-shaped body 30.

Then, screws that are male screws made of metal (not illustrated) are inserted from below the disk part 51 of the top tip 1*b* in the screw insertion holes 53*a*, 21*a*. As a result, the shaft part 1 is assembled.

(Trunk Park 6)

Figure 6:
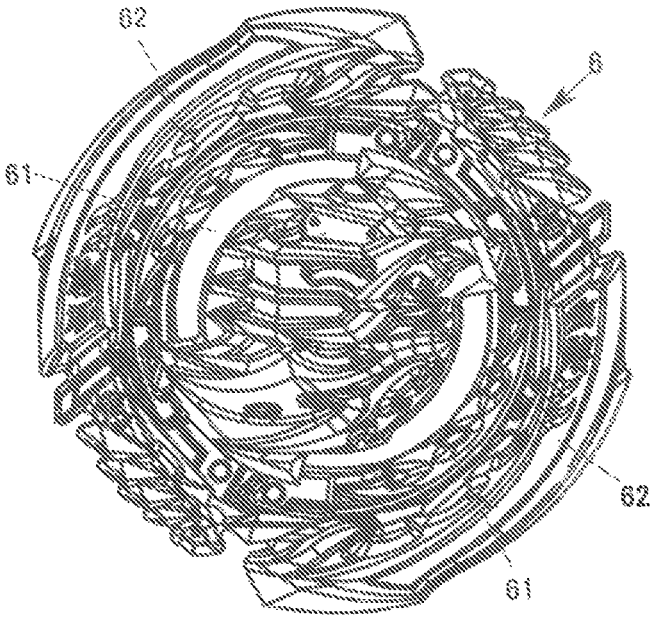
FIG. 6 is a plan view of a trunk part.
Figure 7:
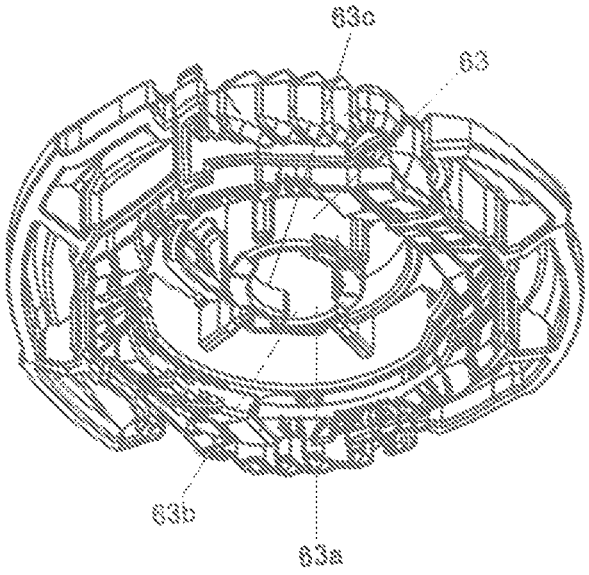
FIG. 7 is a perspective view of the trunk part seen from below.

FIG. 6 is a plan view of the trunk part 6, and FIG. 7 is a perspective view of the trunk part 6 seen from below.

The trunk part 6 is a composite constituted by a plurality of components, with the trunk part 6 configured in a disk shape, and here, two arc-shaped slits 61, 61 are formed concentrically with the top axis. The two arc-shaped slits 61, 61 are formed to be point symmetrical to each other with respect to the top axis.

On the outer circumference surface of the trunk part 6, two large, serrated blades 62 are formed at prescribed intervals in the circumferential direction.

Furthermore, the cylindrical part 63 is provided at the bottom surface center of the trunk part 6. The cylindrical part 63 is fitted into the cylinder body 10 during mounting of the trunk part 6, and presses the ring-shaped body 30 downward. At the inner wall lower end of this cylindrical part 63, two notch parts 63*a* are formed that receive the two claws 22, 22 when fitting into the cylinder body 10. An L shaped groove 63*b* connected to each notch part 63*a* is formed in the inner wall of the cylindrical part 63. The L shaped groove 63*b* is constituted from a vertical groove portion that extends in the top axial direction connected to each notch part 63*a*, and a transverse groove portion extending in the circumferential direction connected to the top end of the vertical groove portion. Then, when mounting the trunk part 6 on the shaft part 1, when the trunk part 6 is pressed on the shaft part 1, the vertical groove portion receives the claw (fifth engagement part) 22, after which by rotation of the trunk part 6 with respect to the shaft part 1, the wall surface (sixth engagement part 63*c*) of the bottom side of the transverse groove portion is engaged with the claw (fifth engagement part) 22, resulting in the trunk part 6 being mounted on the shaft part 1.

On the cylinder body 10, when the trunk part 6 is mounted on the shaft part 1, it is also possible to form a projecting part constituted by recesses and projections on the portion abutting the protrusion 34.

(Flywheel 8)

The flywheel 8 shown in FIG. 3 is formed overall in a cone shape. The bottom side of this flywheel 8 is hollow, and the flywheel 8 is used covering the shaft part 1 from above. The center part of the flywheel 8 is raised sandwiching the groove 81 with respect to the ring-shaped outer peripheral part, and at the center of a raised part 82, a hole 83 in which the cylindrical body 20 is inserted from below is formed.

On the ceiling wall top surface of the raised part 82, two housing frames 84, 84 that bulge upward are formed. The two housing frames 84, 84 are formed to be point symmetrical to each other with respect to the top axis. Below each housing frame 84 is a recess 85 that opens downward and inward of the flywheel 8. In each of the recesses 85, the bulging parts 12 of the shaft part 1 are housed from below.

On each housing frame 84 of the flywheel 8, a protruding piece 86 that extends upward is formed. Each protruding piece 86 is inserted in the corresponding arc-shaped slit 61 from below.

(Mounting of the Trunk Part 6 and the Flywheel 8 on the Shaft Part 1)

The flywheel 8 is placed on the flange part 11 of the shaft part 1. At this time, the housing frames 84, 84 of the flywheel 8 and the two bulging parts 12, 12 of the shaft part 1 are matched, and the cylindrical portion of the cylinder body 10 goes through the center hole 83 of the flywheel 8. As a result, the flywheel 8 is placed on the flange part 11 of the shaft part 1.

Next, the trunk part 6 is placed on the flywheel 8. At this time, the protruding pieces 86 of the flywheel 8 and one end side of the arc-shaped slits 61 of the trunk part 6 (upstream side end part in the rotation direction of the top) are matched. As a result, the notch parts 63*a* of the cylindrical part 63 are matched to the claws 22 of the cylindrical body 20. In this state, the trunk part 6 and the shaft part 1 are pressed against each other, and the trunk part 6 is rotated in the rotation direction of the top with respect to the shaft part 1. As a result, the claw 22 of the cylindrical body 20 is entered in the transverse groove parts of the cylindrical part 63. The, if the hand lets go, the bottom surface of the claw 22 of the cylindrical body 20 is engaged with the wall surface of the bottom side of the transverse groove part, in other words, the sixth engagement part 63*c*.

In this way, when the trunk part 6 and the flywheel 8 are mounted on the shaft part 1, they are attached.

(Top Tip Cover 7)

Figure 8:
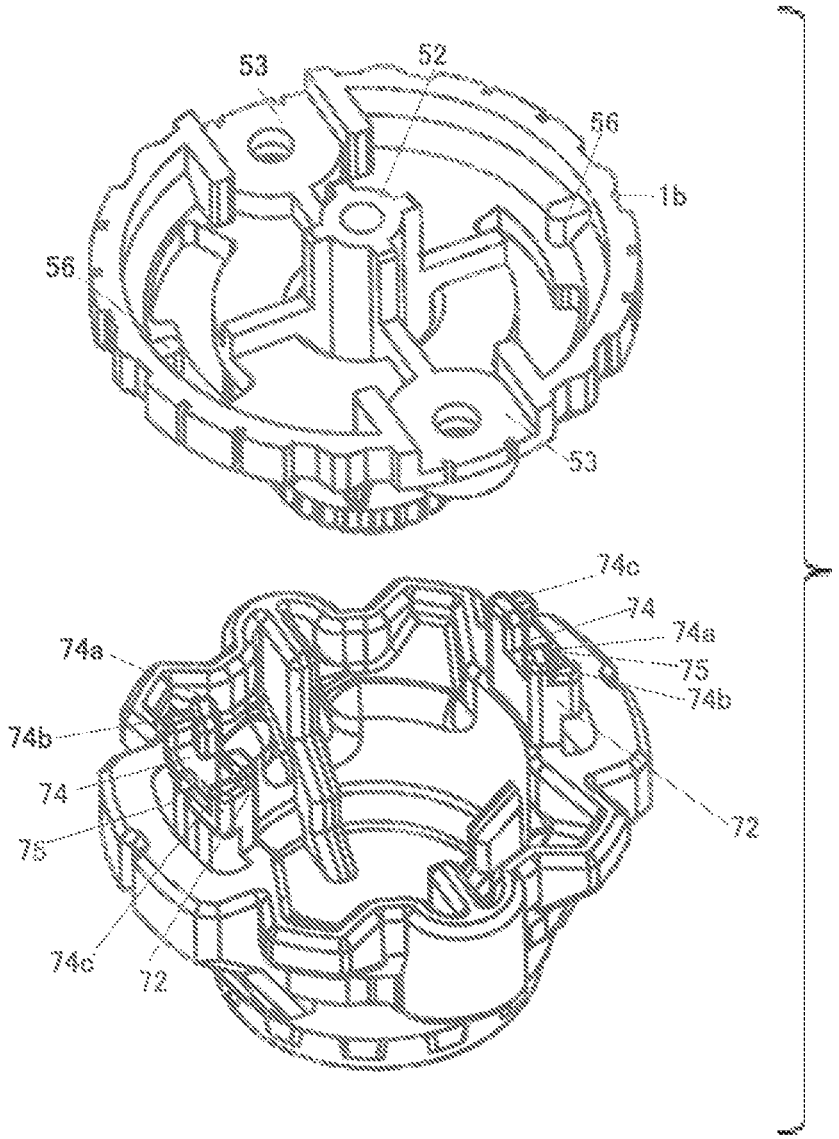
FIG. 8 is a perspective view of the top tip and the top tip cover.
Figure 9:
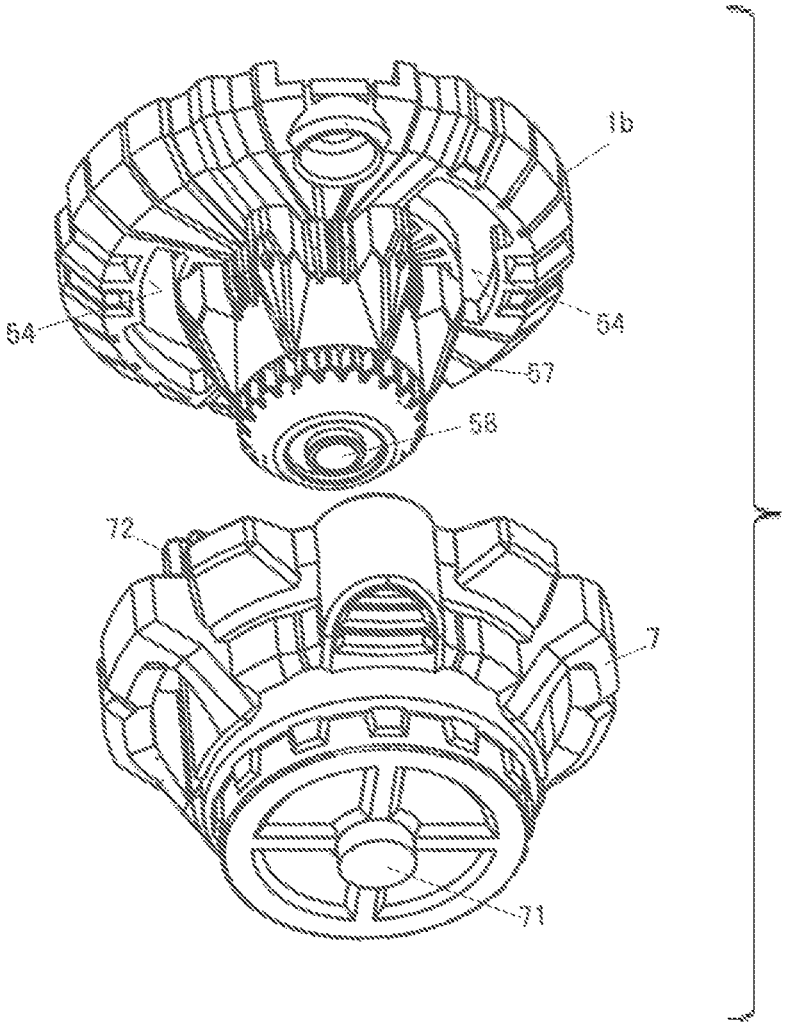
FIG. 9 is a perspective view of the top tip and the top tip cover seen from below.

FIG. 8 is a perspective view of the top tip 1*b* and the top tip cover 7 seen from above. FIG. 9 is a perspective view of the top tip 1*b* and the top tip cover 7 seen from below.

The top tip cover 7 is configured in a bowl shape to be able to completely cover the shaft rod 57. The bottom surface of the top tip cover 7 is flat, and at the center, a short cylinder-shaped landing part 71 is formed. This landing part 71 is formed having a larger diameter than the landing part 58 of the top tip 1*b*.

On the top end of the top tip cover 7, a hook-shaped projecting part 72 is formed. This projecting part 72 stands upright from the top end of the top tip cover 7, and has a shape in which the tip end is bent radially outward. On the top surface of this bent part 77, a seat 74 is formed surrounded on three sides by a wall 74*a* on the radial inward side, and walls 74*b*, 74*c* at both sides in the circumferential direction. This projecting part 72 can be inserted from below in the wide width section 54*a* of the arc-shaped slit 54. Then, in a state inserted from below in the wide width section 54*a*, the projecting part 72 reaches the narrow width section 54*b* of the arc-shaped slit 54 when the top tip cover 7 is rotated with respect to the shaft part 1, the bottom surface of the bent part 77 (third engagement part) and the top surface of the edge of the narrow width section 54*b* of the arc-shaped slit 54 (second engagement part) are engaged, and the top tip cover 7 is assembled to the shaft part 1. Assembly of the top tip cover 7 to the shaft part 1 is done before attachment of the trunk part 6 to the shaft part 1.

A recess 75 for positioning is formed on the tip end of the bent part 77 of the projecting part 72, and this recess 75 for positioning engages with the projection 56 for positioning formed on the disk part 51 of the top tip 1*b* when the top tip cover 7 is rotated with respect to the shaft part 1 to an appropriate position.

(Attachment of the Top Tip Cover 7 to the Shaft Part 1)

Attachment of the top tip cover 7 to the shaft part 1 is done before mounting of at least the trunk part 6 on the shaft part 1.

Figure 10A:
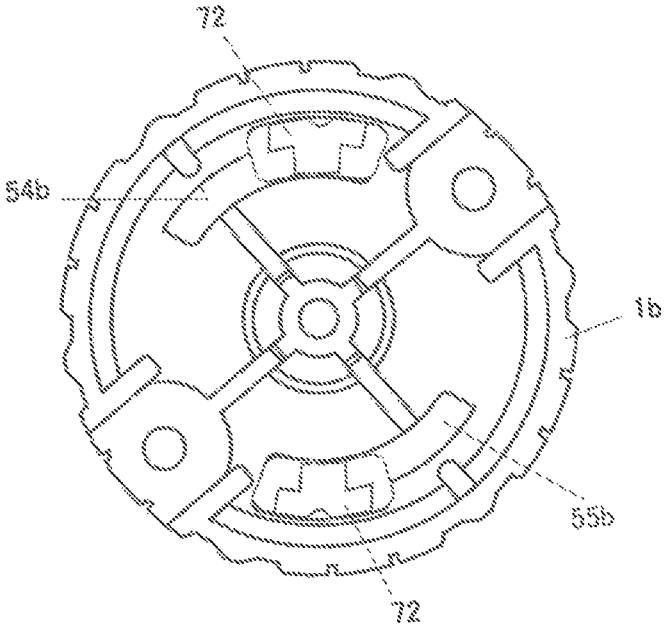
FIG. 10A is a plan view for explaining the attachment procedure of the top tip cover to the top tip.
Figure 10B:
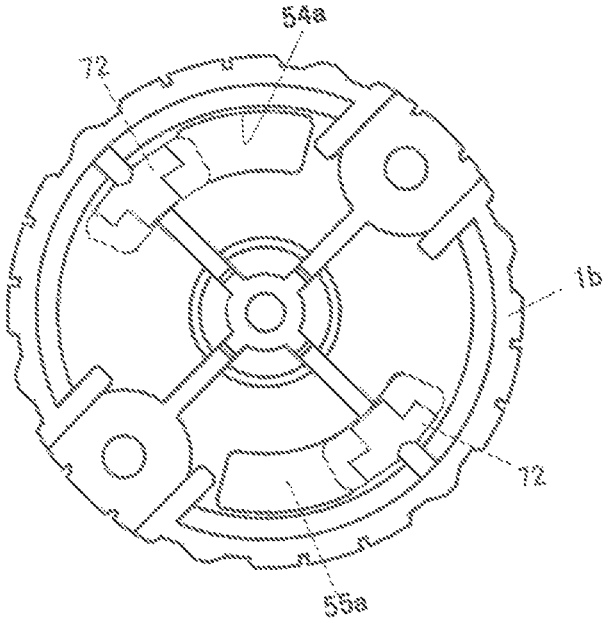
FIG. 10B is a plan view for explaining the attachment procedure of the top tip cover to the top tip.

In light of that, before mounting of the trunk part 6 on the shaft part 1, as shown in FIG. 10A, when the projecting part 72 of the top tip cover 7 is inserted from below in the wide width section 54*a*, and as shown in FIG. 10B, the top tip cover is rotated in the direction of the narrow width section 54*b*, the projecting part 72 reaches the narrow width section 54*b* of the arc-shaped slit 54. Then, the recess 75 for positioning is engaged with the projection 56 for positioning.

In this state, the trunk part 6 is mounted after placing the flywheel 8 on the shaft part 1.

Then, when the trunk part 6 is mounted, the ring-shaped body 30 is lowered, the leg part 31 of the ring-shaped body 30 is placed on the seat 74, and in this state, rotation in the opposite direction with respect to the shaft part 1 is inhibited by the wall 74*c* which is the fourth engagement part. Also, from the position at which engagement between the bottom surface of the bent part 77 (third engagement part) and the edge of the narrow width section 54*b* of the arc-shaped slit 54 (second engagement part) started and until immediately before reaching the prescribed position around the top axis (in other words, the time until the wall 74*b* engages with the leg part 31), the top surface of the wall 74*c* which is the seventh engagement part abuts the lower end of the leg part 31, inhibiting movement to the lowered position, so mounting of the trunk part 6 on the shaft part 1 is prevented.

Figure 11A:
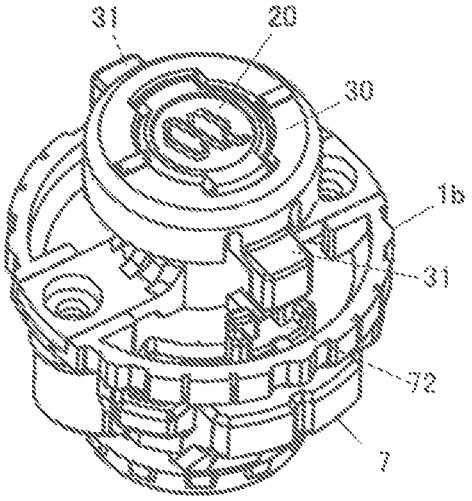
FIG. 11A is a perspective view for explaining the positional relationship between a leg part (first engagement part) and a wall (fourth engagement part) before mounting of the trunk part.
Figure 11B:
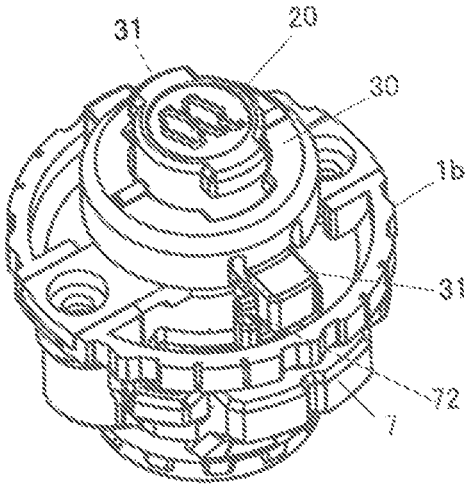
FIG. 11B is a perspective view for explaining the positional relationship between the leg part (first engagement part) and the wall (fourth engagement part) after mounting of the trunk part.
Figure 12A:
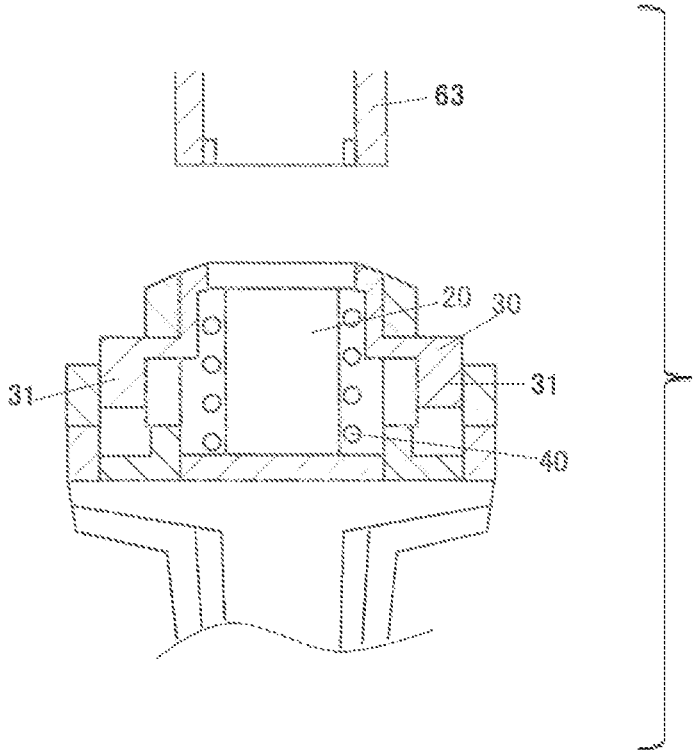
FIG. 12A is a cross section view showing the positional relationship of each part before mounting of the trunk part.
Figure 12B:
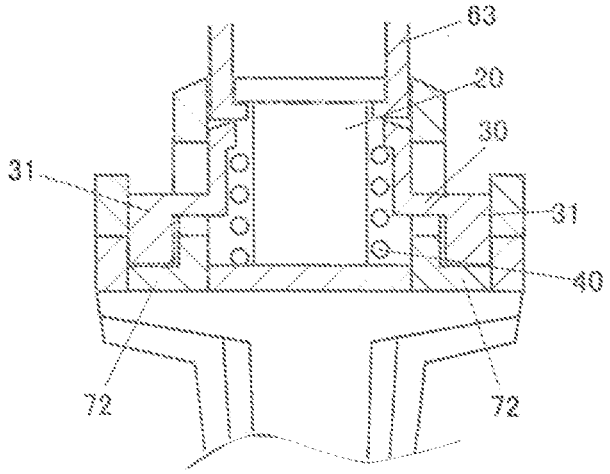
FIG. 12B is a cross section view showing the positional relationship of each part after mounting of the trunk part.

FIG. 11A shows the positional relationship between the leg part (first engagement part) 31 and the wall (fourth engagement part) 74*c* before mounting of the trunk part, and FIG. 11B shows the positional relationship between the leg part (first engagement part) 31 and the wall (fourth engagement part) 74*c* after mounting of the trunk part. Also, FIG. 12A shows the positional relationship of each part before mounting of the trunk part, and FIG. 12B shows the positional relationship of each part after mounting of the trunk part.

Figure 13:
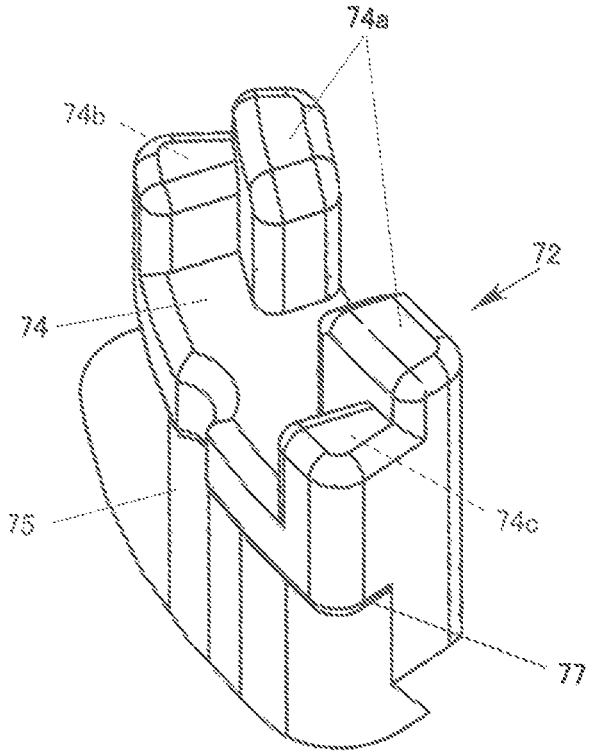
FIG. 13 is a magnified view of a projecting part 72.

As can be understood from these drawings, when the trunk part 6 is mounted on the shaft part 1 after attaching the top tip cover 7 to the shaft part 1, the leg part (first engagement part) 31 and the wall (fourth engagement part) 74*c* are engaged, and that engaged state is locked. In other words, the leg part 31 is inserted in a space formed by the wall 74*c* and placed on the seat 74. FIG. 13 is a magnified view of the projecting part 72 including the walls 74*a*, 74*b*, 74*c*, the seat 74, and the recess 75.

By attaching this top tip cover 7 to the top toy 100, the outside of the form of the top toy 100 changes in the following ways, for example.

First, the top tip cover 7 completely covers the top tip 1*b* of the original top toy 100 from below, so the overall height increases, and also since the top tip cover 7 which has weight is attached, the center of gravity position changes. By this change in the overall height and center of gravity position, the stability, etc., during rotation of the top toy 100 changes.

Second, the bottom surface (flat surface) of the top tip cover 7 has a greater diameter than that of the bottom surface (flat surface) of the top tip 1*b* of the original top toy 100. By this change in the bottom surface diameter, the top toy 100 is less susceptible to tipping over.

Third, the diameter of the landing part 71 of the top tip cover 7 is larger than that of the landing part 58 of the original top toy 100. By this change in the diameter of the landing part 71, the top toy 100 moves around a lot.

As described above, the characteristics of the top toy 100 can be changed by the presence or absence of the top tip cover 7.

If the shape and weight of the top tip cover 7 are changed, it is possible to change the characteristics of the top toy 100 in various ways. For example, it is possible to have a shape in which the top tip cover 7 does not cover the landing part 58 of the original top toy 100. It is also possible to prepare a plurality of top tip covers 7 for which the shapes and weights are different from each other, and each time, to select the top tip cover 7 and attach to the shaft part 1. When attaching the top tip cover 7, conversely, it is also possible to make the shaft tip diameter smaller, or to change the shaft tip raw material (rubber, metal, etc.), or shaft tip shape (polygonal, hemispherical, etc.).

(How to Play)

This kind of top toy 100 is used for battling top toys, for example.

The top toy 100 is rotationally energized using the two arc-shaped slits 61, 61, and is released onto the top toy game table.

Then, when the trunk parts 6 of the top toys 100 collide with each other, when the top toys 100 are in the same rotation direction, the rotation of the trunk part 6 is stopped for a moment and the shaft part 1 continues rotating as is, so the trunk part 6 rotates relative to the shaft part 1, and the engagement position of the claw 22 and the wall surface of the bottom side of the transverse groove part changes. Then, when the battle is repeated, engagement of the claw 22 and the wall surface of the bottom side of the transverse groove part is released, the ring-shaped body 30 is pressed upward by the energization of the coil spring 40, and the trunk part 6 and the flywheel 8 come off from the shaft part 1.

In this case, in an item in which the projecting part constituted from recesses and projections is formed on the portion abutting the protrusion 34 in the cylinder body 10, by engagement of the protrusion 34 and the projecting part, rotational resistance is constituted, so it is more difficult for the trunk part 6 to rotate relative to the shaft part 1, and it is possible to extend the time until the trunk part 6 and the flywheel 8 come off from the shaft part 1.

With this kind of top toy 100, the following main effects can be obtained.

Specifically, the top tip cover 7 is attached to the shaft part 1 by pressing on the shaft part 1 and rotating, and by mounting the trunk part 6 on the shaft part 1, rotation in the release direction of the top tip cover 7 with respect to the shaft part 1 is hindered, so when the trunk part 6 is not mounted on the shaft part 1, the attachment state is reliably locked. Therefore, it is possible to prevent unexpected detachment of the top tip cover 7 that would interrupt the battle.

Also, though the top tip cover 7 is attached to the shaft part 1 by pressing on the shaft part 1 and rotating, while not rotated up to the prescribed rotation position, even when trying to mount the trunk part 6 on the shaft part 1, the leg part 31 contacts the top surface of the wall (seventh engagement part, same wall as fourth engagement part) 74*c* of the projecting part 72, and it is not possible to mount the trunk part 6 on the shaft part 1. Therefore, forgetting to lock the top tip cover 7 can be reliably prevented.

Also, locking of the attachment state of the top tip cover 7 to the shaft part 1 is performed by the ring-shaped body 30 and the coil spring 40 for disassembling the trunk part 6, etc., with respect to the shaft part 1, so a special component for locking is unnecessary.

Above, embodiments of the present invention were described, but the present invention is not limited to the above embodiments, and needless to say, various modifications are possible within a scope that does not change the gist.

For example, the shape of the first engagement part to the seventh engagement part can be any shape as long as it is possible to achieve the goal.

For example, it is sufficient as long as a first engagement part enters the rotation movement region of a fourth engagement part by lowering, and inhibits rotation of the top tip cover 7 with respect to the shaft part 1 in the release direction. Also, the second engagement part and the third engagement part are sufficient provided that the top surface of the second engagement part abuts the bottom surface of the third engagement part to prevent separation of the top tip cover 7 with respect to the shaft part 1 in the top axial direction. For example, both the second engagement part and the third engagement part may be claws.

Also, the fifth engagement part and the sixth engagement part are sufficient provided that the top surface of the fifth engagement part abuts the bottom surface of the sixth engagement part to prevent separation of the trunk part 6 with respect to the shaft part 1 in the top axial direction. For example, both the fifth engagement part and the sixth engagements part may be claws.

Also, the portion corresponding to the seventh engagement part doesn't have to be constituted by the same member (the wall 74*c* in the description above) as the fourth engagement part, and it is sufficient provided that a portion of the trunk part 6 abuts the top end during pressing of the trunk part 6, and it is possible to inhibit lowering of the first engagement part.

In the present specification, the vertical direction indicates the vertical direction seen from a state with the top toy 100 standing up straight. Also, unless specifically noted, "pressing" and "that direction" of one member on another member are relative, and this includes cases of moving one member and another member in a direction closer to each other and pressing, or of moving the other member in the opposite direction and pressing the one member.

INDUSTRIAL APPLICABILITY

The present invention can be suitably used in the field of top toy manufacturing.

Effect of the Invention

According to the first means, by mounting of the trunk part on the shaft part, the first engagement part and the fourth engagement part are engaged, and rotation of the top tip cover in the other direction around the top axis with respect to the shaft part is inhibited, so as long as the trunk part is mounted on the shaft part, the engaged state of the first engagement part and the fourth engagement part is locked, and the top tip cover will not come off from the shaft part.

According to the second means, the first engagement part is provided on the moving body arranged centered on the top axis, so pressing the trunk part from above toward the shaft part during mounting is easier.

According to the third means, by rotation of the trunk part around the top axis with respect to the shaft part in the rotation direction of the top toy, the fifth engagement part and the sixth engagement part are engaged, and the trunk part is mounted on the shaft part, so when an impact reverse to that of the rotation direction of the top toy is applied to the trunk part of the top toy during rotation of the top toy, the trunk part rotates in the direction that releases the engagement between the fifth engagement part and the sixth engagement part with respect to the shaft part, and the trunk part separates from the shaft part, so it is possible to realize a top toy suited for battles between top toys.

According to the fourth means, until the top tip cover reaches the prescribed position around the top axis with respect to the shaft part, mounting of the trunk part on the shaft part is obstructed, so forgetting to lock the engaged state between the first engagement part and the fourth engagement part is reliably prevented.

What is claimed is:

1. A top toy arranged to rotate around an axis, comprising:

a shaft part including a longitudinal end and extending in an axial direction;

a trunk part being detachably configured on the shaft part; and a top tip cover being detachably configured on the shaft part at the longitudinal end, the shaft part including a first engagement part being movably configured between a raised position and a lowered position in the axial direction, the first engagement part being urged towards the raised position, the first engagement part being at the lower position when the trunk part is configured on the shaft part, and a second engagement part being an edge of a slit, the top tip cover including a third engagement part being configured to be engaged by rotating in a first direction with the second engagement part to prevent the shaft part from separating from the top tip cover in the axial direction, a fourth engagement part being integrally formed with the third engagement part, the fourth engagement part extending through the second engagement part, the fourth engagement part being configured to be engaged above the second engagement part with the first engagement part to prevent the top tip cover from rotating in a second direction with respect to the shaft part, where the first direction is opposite to the second direction, the top tip cover being arranged to be in contact with a floor when the top tip cover is configured on the shaft part, the shaft part being arranged to be in contact with the floor when the top tip cover is not configured on the shaft part, the shaft part including a fifth engagement part, the trunk part including a sixth engagement part being configured to be engaged with the fifth engagement part to prevent the shaft part from separating from the trunk part in the axial direction.

2. The top toy according to claim 1, wherein the shaft part includes a moving body including a center on the axis, and the first engagement part is configured on the moving body.

3. The top toy according to claim 1, wherein the shaft part includes a seventh engagement part being configured to abut and to be engaged with the first engagement part to prevent the first engagement part from lowering further than the fifth engagement part.

4. The top toy according to claim 1, wherein the second engagement part is configured on the shaft part, the third engagement part is a bent part configured on a tip of a protruding part protruding towards the shaft part, the edge is configured to hold the bent part.

5. The top toy according to claim 4, wherein the first engagement part is a leg part extending downwardly towards the floor, the fourth engagement part is constituted by three walls forming a space having a convex shape, and the leg part is inserted in the space.

6. The top toy according to claim 4, wherein the protruding part includes a recess, the shaft part includes an inner wall, the inner wall includes a protrusion at the slit, and the protrusion is engaged with the recess when the top tip cover is configured on the shaft part.

7. A top toy arranged to rotate around an axis, comprising:

a shaft part including a longitudinal end and extending in an axial direction;

a trunk part being detachably configured on the shaft part; and a top tip cover being detachably configured on the shaft part at the longitudinal end, the shaft part including a first engagement part being movably configured between a raised position and a lowered position in the axial direction, the first engagement part being urged towards the raised position, the first engagement part being at the lower position when the trunk part is configured on the shaft part, a second engagement part, the top tip cover including a third engagement part being configured to be engaged by rotating in a first direction with the second engagement part to prevent the shaft part from separating from the top tip cover in the axial direction, a fourth engagement part being integrally formed with the third b engagement part, the fourth engagement part extending through the second engagement part, the fourth engagement part being configured to be engaged above the second engagement part with the first engagement part to prevent the top tip cover from rotating in a second direction with respect to the shaft part, where the first direction is opposite to the second direction, the top tip cover being arranged to be in contact with a floor when the top tip cover is configured on the shaft part, the shaft part being arranged to be in contact with the floor when the top tip cover is not configured on the shaft part, the second engagement part being an edge of a slit configured on the shaft part, the third engagement part being a bent part configured on a tip of a protruding part protruding towards the shaft part, the edge being configured to hold the bent part, the first engagement part being a leg part extending downwardly towards the floor, the fourth engagement part being constituted by three walls forming a space having a convex shape, the leg part being inserted in the space, the protruding part including a recess, the shaft part including an inner wall, the inner wall including a protrusion at the slit, the protrusion being engaged with the recess when the top tip cover is configured on the shaft part, the shaft part including a fifth engagement part, the trunk part including a sixth engagement part being configured to be engaged with the fifth engagement part to prevent the shaft part from separating from the trunk part in the axial direction.

* * * * *